United States Patent [19]

Dodds

[11] 4,443,389

[45] Apr. 17, 1984

[54] HEAT EXCHANGE APPARATUS

[75] Inventor: Diego E. F. Dodds, Buenos Aires, Argentina

[73] Assignee: Leonard Oboler, Key Biscayne, Fla.; a part interest

[21] Appl. No.: 281,151

[22] Filed: Jul. 7, 1981

Related U.S. Application Data

[63] Continuation-in-part of Ser. No. 258,136, Apr. 27, 1981.

[51] Int. Cl.[3] ..... B01F 3/04

[52] U.S. Cl. ..... 261/153; 261/25; 261/DIG. 11; 138/38; 165/179; 165/84

[58] Field of Search ..... 165/84, 179; 261/25, 261/DIG. 11, 153; 138/38

[56] References Cited

U.S. PATENT DOCUMENTS

| | | | |
|---|---|---|---|
| 621,718 | 3/1899 | Seymour, Jr. | 261/25 |
| 719,921 | 2/1903 | Webster | 138/38 |
| 1,501,646 | 7/1924 | Brown | 165/84 |
| 2,081,612 | 5/1937 | Woodson | 138/38 |
| 2,254,587 | 9/1941 | Williams | 165/179 |
| 2,300,058 | 10/1942 | Osborn, Jr. et al. | 138/38 |
| 2,551,710 | 5/1951 | Slaughter | 138/38 |
| 2,733,908 | 2/1956 | Graham | 165/179 |
| 2,905,447 | 9/1959 | Huet | 165/179 |
| 3,053,512 | 9/1962 | Soudan et al. | 165/84 |
| 3,071,159 | 1/1963 | Corraggioso | 138/38 |
| 3,141,909 | 7/1964 | Mayo, Jr. | 165/179 |
| 3,195,870 | 7/1965 | Gruber et al. | 261/25 |
| 3,253,819 | 5/1966 | Talbot | 261/25 |
| 3,508,608 | 4/1970 | Roe | 165/179 |
| 3,633,663 | 1/1972 | Tafel | 138/38 |
| 3,669,421 | 6/1972 | Murphy | 261/25 |
| 3,921,711 | 11/1975 | Westbrook | 165/177 |
| 4,118,944 | 10/1978 | Lord et al. | 138/38 |
| 4,154,296 | 5/1979 | Fijas | 165/179 |

FOREIGN PATENT DOCUMENTS

| | | | |
|---|---|---|---|
| 195525 | 10/1973 | Argentina . | |
| 206846 | 8/1976 | Argentina . | |
| 1493 | 6/1900 | Austria | 261/25 |
| 679451 | 8/1939 | Fed. Rep. of Germany | 165/84 |
| B 26929 | 10/1955 | Fed. Rep. of Germany | 138/38 |

*Primary Examiner*—Tim R. Miles

*Attorney, Agent, or Firm*—Jim Zegeer

[57] ABSTRACT

The present invention is directed to heat exchange apparatus in which a cooling tower having coils carrying heated water from a facility in a closed circuit system are mounted such that the coils, by means of multi-directional thermal expansion, crack scale and other film from the surface thereof. The improvement is directed to the internal flow path of heated fluid in the closed circuit which includes turbulator means to enhance agitation and vibration of the coils thereby increasing efficiency and avoiding the build-up of the scale on the smooth external surfaces of the cooling coils. The cooling tower may include a turbine driven fan which utilizes as a motive fluid water for cooling and washing the coils of scale.

24 Claims, 16 Drawing Figures

HEAT EXCHANGE APPARATUS

REFERENCE TO PRIOR APPLICATION

This application is a continuation-in-part of my application Ser. No. 258,136 filed Apr. 27, 1981 for "Heat Exchange Apparatus and Method".

BACKGROUND ART AND BRIEF DESCRIPTION

The present invention is to provide an improved heat transfer in the apparatus described in my Argentine Pat. Nos. 195,525 of Oct. 15, 1973 and 206,846 of Aug. 23, 1976 and the system as further disclosed in an article published by me in 1974 for the handling of water (both cooling and cooled) in the cooling towers. Heat exchangers with internal turbulators are known in the art, see for example Mosier U.S. Pat. No. 3,734,135, reissued U.S. Pat. No. Re. 20,016, French Pat. No. 3,776,018 and Westbrook U.S. Pat. No. 3,921,711. However, these are concerned with rigidly mounted, usually straight, tubes and none of them are in the shape of coils mounted so as to permit expansion and contraction of the surfaces of the coils for self cleaning purposes. It is a major feature and objective of the present invention to provide improved cooling coils structure and assembly for cooling towers as disclosed in my above-identified Argentinian patents.

Cooling towers and related equipment generally have an electric or hydraulic motor for driving the fan for impelling air through the cooling tower for enhancing the evaporative cooling process, the fan or blower serving to activate the air flow in open circuit cooling towers, closed circuit cooling towers, evaporative condensors and evaporative oil coolers and the like. In these as well as other related applications water or fluid to be cooled and or used as a cooling media are generally sprayed via nozzles in the cooling tower. The purpose of the nozzle is to increase the surface area and corresponding evaporation rate when exposed to the air. Energy to spray the water from the nozzle is generally provided by the water supply pressure and corresponding distribution pump. A fan is then used to move air through the heat exchanger which air conveys away the heat released by the evaporative cooling process taking place. The fan is generally driven by an electric or hydraulic drive and the motor is direct coupled pulled by a belt connector that has speed reduction via gear drives or any such mechanical transmission which are standard in the art. In summary, in a normal evaporative process there is always a requirement for the flow of water or cooling media accompanied by a corresponding flow of air. Energy is therefore required to pump the water through the spray nozzles and energy is generally provided as well in order to drive the fan which moves the air. In this connection, in the past, turbine fan drives for cooling towers utilizing impulse turbines for driving the air fan or blower are known in the art as exemplified in Mart et at U.S. Pat. No. 2,672,328, Mayo Jr. U.S. Pat. No. 3,141,909, Talbot U.S. Pat. No. 3,253,819 and Murphy U.S. Pat. No. 3,669,421. However, in this art, such turbine drives have not been widely adopted. There are applications where it is desirable to control the final temperature of the outgoing cooled fluid and keep this fluid within certain temperature limits. One of the common methods employed is to throttle the speed of the fan, modifying the air flow and consequently the evaporation rate.

According to the present invention, an impulse blade turbine mounted on a common shaft with a fan and as a result of which the water to be cooled is used as a prime mover to move the turbine and drive the fan. By adjusting and/or regulating the amount of water impinging upon the turbine blade, a sympathetic vibration can be developed in the movement of the coils which results in an easier cleaning action of the coils disclosed in my above-identified Argentinian patents and the turbulated coils disclosed herein. As a result of the easier and better cleaning action, there is a more efficient heat transfer through the tower.

The above and other objects, advantages and features of the invention will become more apparent when considered in conjunction with the following specification and accompanying drawings wherein:

FIG. 1 is a schematic illustration of a cooling tower having cooling coils mounted in the manner disclosed in my above-identified Argentinian patents and provided with turbulators as shown in FIGS. 2–10, FIG. 2 is an embodiment of the invention in which the internal surfaces of the coils are provided with triangularly shaped fins and the like, FIG. 3 shows a spiral metal or plastic strip in ribbon form inserted in the tube as a turbulation device, FIG. 4 is a further embodiment of the invention in which an innercore of a hollow or solid is to reduce the flow section within the tube and increasing the velocity thereof, FIG. 5 shows an innercore as shown in FIG. 4 with a helical fin thereon, FIG. 6 is a further embodiment of the invention for achieving pulsating and turbulant flow by means of beads on a chain, FIG. 7 is an embodiment similar to FIG. 6 but using a metal or plastic chain with links, FIG. 8 is a modification of the embodiment shown in FIG. 2 in which the tubes have been given a certain amount of twist to attain a turbulant flow, FIG. 9 is a further modification showing a torsional insert to create turbulance, FIGS. 10*a* and 10*b* are further embodiments of inserts for the tubes which may or may not be twisted for turbulation purposes;

FIG. 11 illustrates a further embodiment of the invention in which the water is driven both by gravity and the impelled air onto a distributor pan or disk, FIG. 12 is a modification of the invention illustrated in FIG. 11 wherein the impulse turbine blades shown in FIG. 12*a* serves both the purpose of driving the fan and the purpose of obtaining distribution of the water across the tower fill or heat exchange surface in the cooling tower, FIGS. 12*b* and 12*c* are diagrammatic illustrations of turbine blades use in the invention, and FIG. 13 is a further modification of the cooling tower shown in FIG. 11 in which the axis of the impulse turbine and blower are horizontal.

DETAILED DESCRIPTION OF THE INVENTION

In my above-identified Argentinian patents, I disclose a really unique and highly effective cooling tower which has smaller cooling coils and extended surface area which represented a considerable saving in weight over standard construction. The present invention are significant improvements over that technology.

Figure 1:
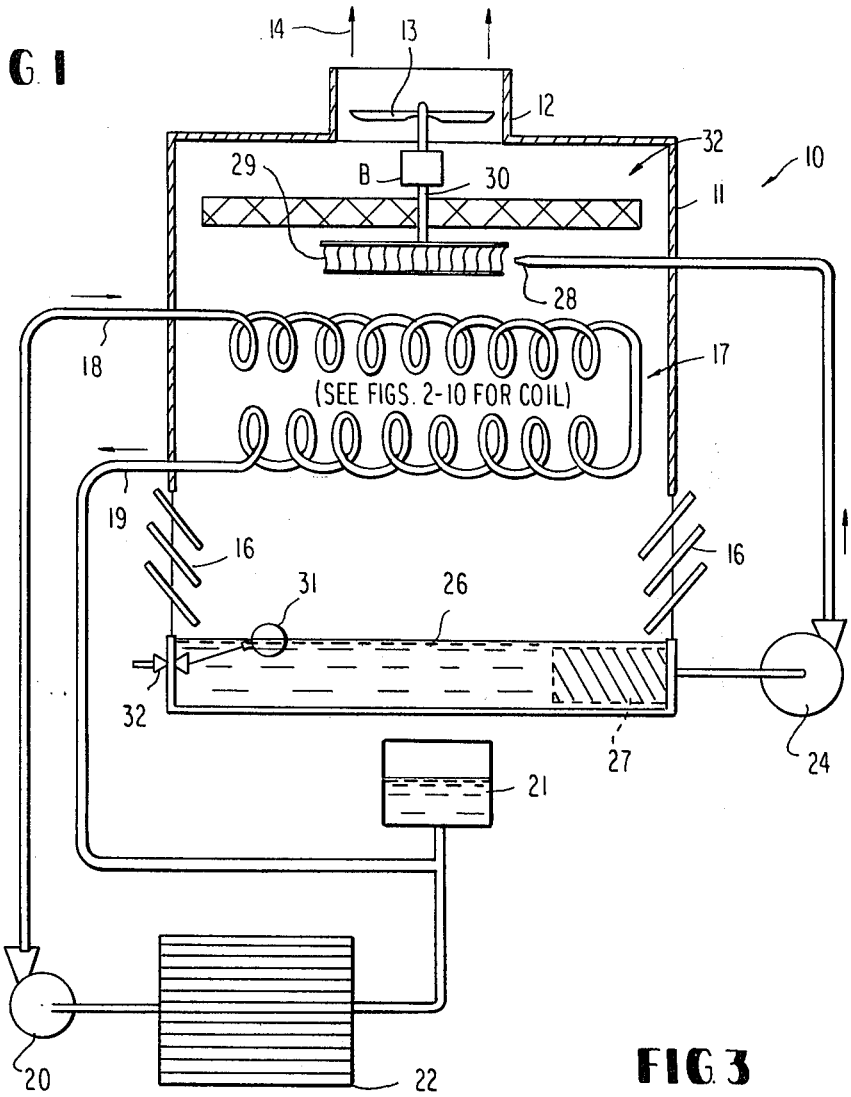

Referring now to FIG. 1, the cooling tower 10 includes a housing 11 having a cowl 12 at the upper end in which is contained blower 13 for the causing movement of air in the direction indicated by the arrows 14, in this case, outwardly, air being admitted through vents or louvers 16 in the lower end of housing 11. A closed circuit cooling system includes a bank of coils 17, inlet and outlet fittings 18 and 19 respectively, pump 20 and storage receptacle 21. The utilization facility which is being cooled is designated by 22. The pump 20 draws cooling liquid or medium from the utilization device 22 and forces it through helical coils 17 which are constructed, mounted and arranged so as to permit surface movement as by expansion and contraction of the surfaces thereof to crack and remove any sediment forming on the smooth surface of the coils. In a preferred embodiment, the coils 17 are formed of a light weight metal having a high temperature expansion coefficient, such as aluminum. Specific details of the internal structure of coils is illustrated in FIGS. 2 through 10.

Coils 17 are all smooth surfaced on the exterior and are mounted and arranged so as to be freely expandable and contractable to expand and contract with the thermal expansion and contraction processes thereabout. In the illustrated embodiment, the coils 17 have distributed thereover cooling fluid, such as water, which is pumped by a pump 24 from a storage reservoir 26 in the lower end of cooling tower housing 11, through a filter 27 to a nozzle 28. A mounting bracket "B" carries an impeller of an impulse turbine 29 is coaxially mounted on the shaft 30 of blower 23 so that the fluid ejected from nozzle 28 impacts on the blades of impeller 29 to rotate blower 30. A float 31 controls a valve 32 for admiting make up water. Air in this case is drawn through the louvers 16 and upwardly through the cooling coils in counter flow direction with respect to the flow of cooling water through a packing element 32 which removes the water from the air stream and the air exits through cowling 12 to the atmosphere. The coils 17 shown in FIG. 1 are designed to enhance the heat transfer between the cooling medium on the exterior surfaces of the coil (a mixture of air and water) and the heat exchange medium flowing in the closed circuit to the utilization device 22.

The basic heat transfer equation is:

$$Q=FXU(T1\text{-}T2), \quad (1)$$

where Q=the heat transfer through a solid wall from the fluid on one side to the fluid on the other side and expressed in BTU's per hour, F=the surface area through which the heat will flow expressed in square feed, U= the overall coefficient of heat transfer which is in essence the reciprocal of all the resistances to the flow of heat, resulting from physical characteristics of the laminar flow of the fluids, the resistance to flow through material of the walls, any insulation that may exist, etc. This is expressed in BTU's per hour per degree fahrenheit.

The object of the presented inventions is to reduce the size of the heat exchanger normally required to dispell a fixed quantity of energy; the heat exchanger size will be determined by the coils or tubes through which a closed circuit fluid could flow. A reduction in the size of the heat exchanger will result in the obtaining the following benefits:

(1) A lower cost of materials both in the heat exchanger, its coils, and the corresponding supporting frames, structures, and enclosures.

(2) A far more compact design of the cooling tower, thereby enabling a more efficient flow of air through the cross-section area and (3) A reduced overall weight.

Considering that for a particular heat transfer problem there would be two factors in equation 1 which are fixed ((A) the heat load Q, and (B) the temperature of the fluids) actually it is apparent that two remaining factors will govern the efficiency and operation of the tower. These remaining factors are (1) F, the surface area and (2) U, the heat transfer coefficient. These are the two factors upon which this invention will act thereby altering and improving the performance of the cooling tower accordingly.

The invention disclosed in Argentine Pat. Nos. 195,525 and 206,846 contemplated utilizing tubes which are in turn used to make coils. The tube material was a smooth material thin walled and a heat transfer surface corresponding to the mean diameter of the inner and outer walls.

Figure 2:
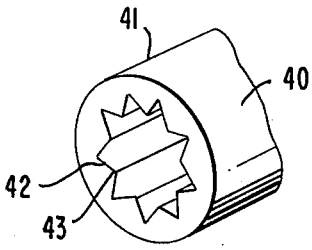

FIG. 2 illustrates a cross-section of the tube 10 forming the coils 17 of the heat exchanger. This tube 10 has a smooth surface 41 on the outside, that is to say the surface exposed to the liquid utilized in the open circuit, and occuring where scale build-up is most likely to occur.

Figure 8:
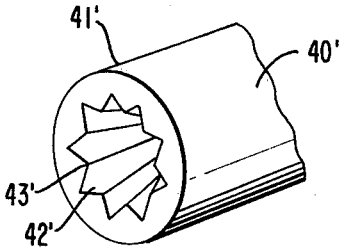

The inner tube walls 42, that which is in contact with the closed circuit cooling fluid, is produced with protuberences 43 or other variations of surface, in order to achieve a significant increase of surface area in contact with the fluid. Further, if these protrusions or vanes follow a spiral path around the axis of the tube 40, as shown in FIG. 8, then the fluid would tend to follow the same path, creating a corresponding increase in turbulance and mixture of the passing fluid within the tube. Cooling tubes having turbulance creating internal surfaces are known in the art. However, when such internal structures are combined in cooling systems disclosed in the above-identified Argentine patents, the turbulance enhances the film removed thereby improving the cooling efficiency.

The velocity and turbulance of the fluid will determine the film fracture characteristics of the enclosed liquid, and thereby result in a lowering of the heat resistance coefficient. Further, the higher the velocity and greater the turbulance of the fluid, the better shall be its ability to surrender or absorb energy. Therefore, if the value of U is increased, the value of F could be reduced in equation 1.

FIG. 2 indicates a cross-section of the tube 40. As indicated previously the inner vanes 41 could follow a spiral pattern (FIG. 8). Actually, the vanes could also run straight through along the tube axis, and be twisted or not prior to forming the coils compromising the heat exchange surfaces of the cooling tower.

Other methods exist to increase the area and also the turbulance occuring within the tubes, and for this we refer to the further FIGS. 3–10.

Figure 3:
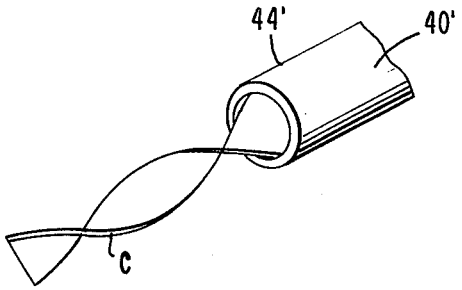
Figure 4:
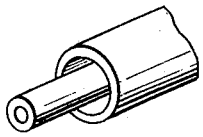
Figure 5:
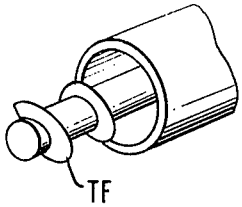
Figure 6:
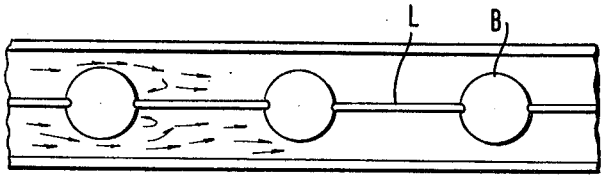
Figure 7:
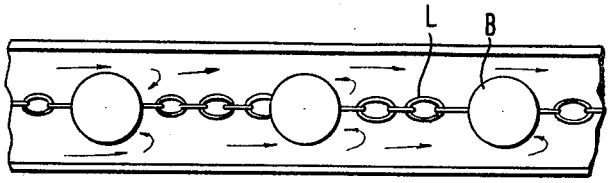
Figure 9:
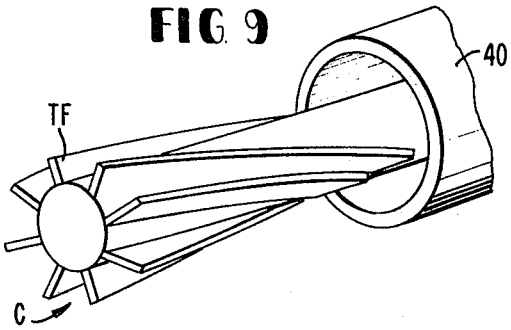
Figure 10A:
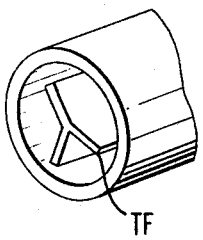
Figure 10B:
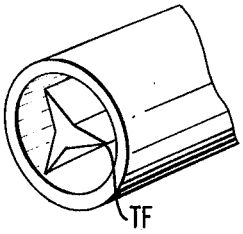

As shown in FIGS. 3, 4, 5, 6, 7, 9, 10*a* and 10*b*, the turbulator is constituted by an inner core C for reducing the flow section of water and increasing the velocity therein. In FIGS. 3, 5 and 9, a helical fin HF is carried on the core C. In FIGS. 6 and 7, the turbulator is constituted by a plurlarity of sequentially connected beads B for causing eddy currents ED induced by accelerated fluid flow and links L interconnect said beads B. As shown in FIGS. 5, 9, 10*a* and 10*b*, the core C includes a plurality of torsion fins TF which, as shown in FIGS. 10*a* and 10*b*, are star shaped in cross section.

In all of these, in contrast to the prior art, where the effort is to increase the surface area for contact with the second fluid, it is important that the exterior surface of the tube be as smooth as possible, in order to facilitate the self-cleaning characteristics mentioned and forming the basis of my above-identified Argentine patents.

All of the devices FIGS. 2–10 can therefore be used for plain tubing with smooth walls on both sides, as described in the Argentine patents, although it is obvious that inclusion of the variations mentioned herein would result in benefits to the user's and manufacturers of the cooling tower.

In conclusion, I have disclosed different ways by means of which the size of the heat exchanger could be reduced. Any of these method or devices could be used separately or in combination with any of the others, or in combination with devices as indicated in my Argentinian patent, in order to provide highly efficient and useful cooling towers.

Figure 11:
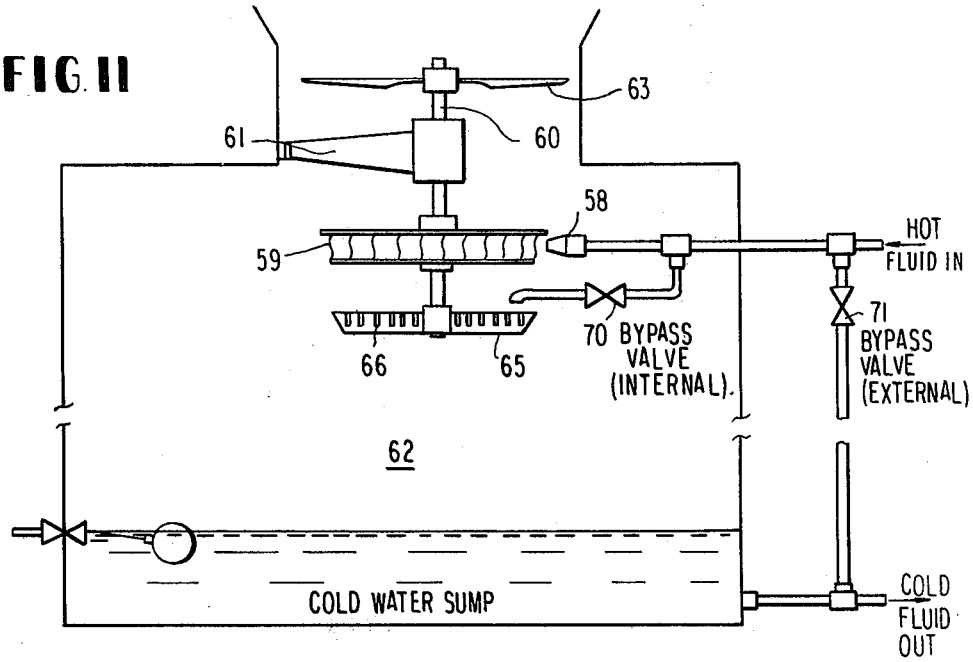
Figure 12B:
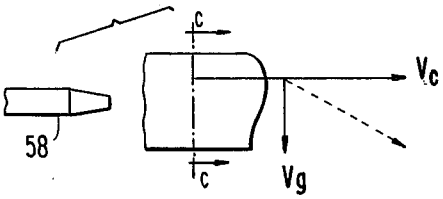
Figure 12C:
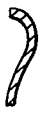
Figure 12:
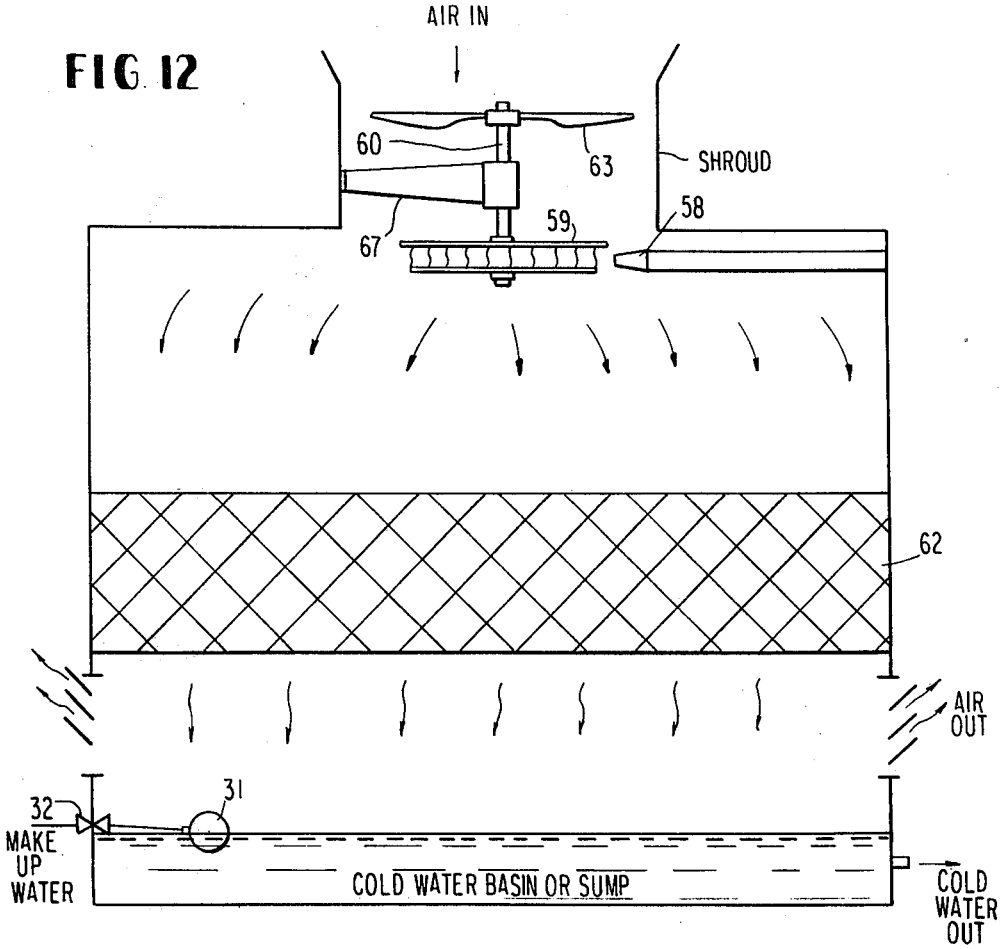
Figure 13:
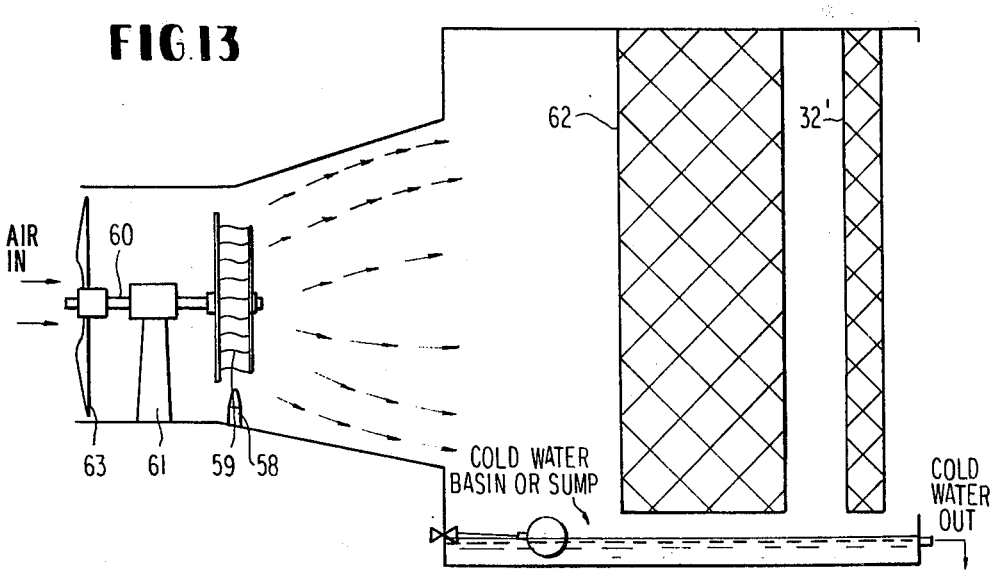

The embodiment of the invention shown in FIGS. 11, 12 and 13 are applicable to any situation where massive fluid is to be used for an evaporative cooling process, with the assistance of a fan or blower to activate air flow.

Representative applications of evaporative cooling process are indicated but not limited to the following examples:

(A) Open circuit water cooling towers
(B) Closed circuit water cooling towers
(C) Evaporative condensors
(D) Evaporative oil coolers In these, as well as other related applications, water or fluid to be cooled and or used as a cooling media are generally sprayed via nozzles. The purpose of the nozzle is to increase the surface area of fluid and the corresponding evaporation rate when exposed to the air. Energy to spray water from the nozzle would generally be provided by the water supply pressure and corresponding distribution pump. A fan is then used to move air through the heat exchanger, which air conveys away the heat released by the evaporative cooling process taking place the fan would generally be driven by a electric motor or hydraulic drive, and the motor could be direct coupled, pull and belt connected, or have speed reduction via gear drives, or any mechanical device.

In summary, in a normal evaporative process there would always be a requirement for a flow of water or cooling media accompanied by a corresponding flow of air.

Energy would therefore be required to pump the water through the spray nozzles, and energy is generally provided as well in order to drive the fan which moves the air.

There are application where it is desirable to control the final temperature of the outgoing fluid, or keep this fluid within certain temperature limits. One of the common methods presently employed is to throttle the speed of the fan, modifying the air flow and consequently the evaporation rate.

This invention is based upon utilization of an impulse blade turbine, mounted on a common shaft with the fan, and as a result of which the water to be cooled would be used as the prime move to move the turbine and drive the fan.

With the turbine efficiency of 100%, it would indicate that the energy of the water impinging on the turbine blades would be used 100% for rotation of the fan, and the water having surrendered its energy would drop vertically down because of gravity to the area beneath the blades of the turbine. Under these circumstances, although maximum energy would be imparted to rotation of the fan, the evaporative cooling process would be a minimum, since the system as contemplated bases functioning upon spraying or pulverizing of the water in order to attain the maximum conversion of sensible heat into latent heat which in turn would must occur within the air stream within the tower.

This invention accomplishes several alternate or combined solutions in order to achieve the spray effect that would project the water across the cross-section of the tower as follows:

Referring to FIG. 11 assuming a very efficient turbine drive, the water rotating the turbine blades 59 is issued through nozzle 58 and then drops straight down by gravity and falls onto a distribution pan or disc 65, mounted upon a extension of the turbine and fan shaft. This pan or disc 65 could either be flat or have slots or vanes 66 placed along its peripheral or along its radia, in order that the water breakup into a fine spray which, due to centrifugal force, would travel outward spreading over the cross-section of the tower. Selection of the physical characteristics of the distribution disc or pan 66 would depend upon velocity of the rotation as well as other factors in order to attain the fineness of spray desired. As shown in FIG. 11, instead of directing all of the tower fluid on the impeller blade buckets, a valve 70 controls the flow of fluid directly to distribution disk 65.

An impulse turbine with blades of the proper configuration might serve both purposes, which are to drive the fan, and also obtain a good distribution of water across the cooling tower surfaces. In such case, the arrangement shown in FIG. 12 would be the preferred arrangement. It will be noticed that in this case, as opposed to the counter flow (air vs. water) of FIGS. 1 and 11, the air flows down in a parallel way to the flow of the water, which also falls by gravity. As shown above, it must be taken into account however that in desirable and selected cases, it can be convenient to have the air moving contrary to the movement of the water and pass through a drift eliminator 32 mounted above the turbine fan (See FIG. 1).

Going back to the preferred direction of water and air flow, the incoming air would mix with the water or fluid droplets and proceed down through the fill or heat exchange surface. In many cases, and given a fine spray an intimate contact of the water droplets with the incoming air, it could be possible that no fill is required, heat exchange taking place in the air space confined within the tower perimeter.

FIG. 13 depicits another solution, a horizontal flow solution. Here again, due to special confuguration of the turbine blades, see FIG. 12*b* and 12*c*, and on account of the centrifugal force of the water, this water would be projected into the air and carried inside the tower where the evaporative cooling process would take place.

As indicated earlier, it could be necessary to occasionally reduce the cooling effect of the system in order to hold the temperature of the cooled fluid within certain limits. This could easily be obtained under the invention through throttling the water supply which causes a corresponding reduction in the rotational speed of the fan. So as not to disrupt the normal flow of fluid which carries the actual heat load, there is disclosed in FIG. 11, three alternate ways of accomplishing this. With the internal by-pass valve 70 in the drawing the function of water which does not pass through the turbine nozzle 58 flows into the distributors 65 where it would be broken down into droplets and make its way onto the tower fill and consequently return to the system. Alternatively by via an external by-pass valve 71 simply feeding back into the cold water return pipe going into the equipment generating the heat load to start with. A combination of both valves 70 and 71 could be used as the best solution in some cases.

Outstanding Features:

1. Elimination of the fan drive motor by replacing requirement with an increase in the size of the circulating pump motor. By using only one larger motor, overall efficiency would be greater and consequently a power saving will result. In addition, elimination of a major cause of maintenance is attained, inasmuch as the fan drive motor is generally that which causes the most problems in cooling tower operation.

2. Elimination of all of wires and starters for the fan motor and consequently control problems.

3. Elimination of one of the major problems in cooling towers maintenance, burnt out electrical motors due to ambient exposure.

4. By throttling the water supply to the nozzle, the turbine can render a stepless speed reduction of the fan. In large installation this could represent an important power factor and also result in infinate control of cooling possibilities.

5. Throttling devices to modify the fan speed, via the turbine, are simple and inexpensive as compared to conventional costly mechanical or electrical speed control devices.

6. Taking a further account of item 5 it is now possible to utilize the benefit of variable speed fan control in small capacity cooling systems.

7. The overall initial and maintenance cost of all hydraulic systems vs. a conventional electric motor for drive and spray nozzles would result in an initial cost.

Depending upon the application and use of the cooling tower, it would probably be convenient to further consider design of the impulse turbine wheel. In all of the previous cases we have assumed that a wheel will be designed for maximum efficiency of conversion of mechanical to rotational mchanical energy in the fluid to rotational energy. However, design of the impulse turbine might be such that a far less than efficient design be the best solution. In other words, it may be convenient to eliminate the dish or disk beneath the prime mover and accomplish all of these aims through a delivered reduction in efficiency of conversion of mechanical to rotation energy mechanical energy of the fluid to rotational energy of the device. In other words, design of the actual blades, part of which will be utilized for rotation and the other part of which will be used for disbursement of the incoming fluid all of this of course is an alternate to the design already indicated.

As shown in FIG. 12*c*, the blades or buckets of the impeller of the turbine are shaped so that some of the energy of the incoming water is used, not to impart a force to the turbine wheel, but to enhance the formation and distribution of water droplets and direct same in the desired direction. Thus the blade is shaped as shown so that a large part of the energy is converted to rotation of the turbine wheel, while that portion of the energy which is not transformed is used directed to droplet formation and spreading. As shown in FIG. 12*b*, the vectorial diagram shows some of the energy denoted Vc used to apply a centrifugal force to those fluid particles impinging on the curved surface of the blade and some of the energy denoted Vg, applying a downward force on some of the particles of water. This achieves a more uniform droplet formation and distribution and, at the same time provides a very closely controllable drive to the turbine for control over the fan and, hence, air flow through the tower.

By regulating the pressure and amount of water impinging upon the turbine prime mover, it is possible that one could combine, selecting a proper number of blades, with the turbulated coils of this invention. In other words, it is relatively easy to cause a sympathetic vibration, a deliberate movement of the coils, which would result in an easier cleaning action and consequently a better heat transfer through the tower.

The coils structures described above which will apply to the tower already described as well as the following one described later herein has to do with a reduction in weight. It is natural that elimination of the motor on top with its corresponding drive equipment such as reduction gear, belt drives, etc . . . represent another step forward in reduction of the weight of the unit. As indicated previously, the Argentine unit with its small coils and extended surface area already represents a considerable saving in weight over standard construction and this new impulse turbine drive will further inhance this advantage. This new application of the device already indicated which is really a turbine operated fan beneath which is mounted a disk or dish to spray water, can be further utilized in open circuit cooling tower applications. The same idea would enable one to have additional sprays further down along a water that comes into the unit and spray it two or three areas one beneath the other. The advantage of this would be to eliminate the requirement for a fill material within the tower, increase the area of contact between the same amount of fluid and the fixed amount of air provided by the fan mounted at the top.

While I have illustrated and described various preferred embodiments of the invention, it will be appreciated that the invention is subject to other modifications, which do not depart from the spirit and scope of the invention as set forth in the following claims:

I claim:

1. In a light weight cooling tower having helical coils having smooth external surfaces and carrying heated water from a facility in a closed circuit system, said coils being mounted such that surface movements as by multidirectional thermal expansion and contraction of said coils crack scale and other film from said smooth external surfaces thereof, the improvement wherein the internal flow path of heated fluid in said closed circuit system includes turbulator means to enhance agitation and vibration of said coils thereby increasing the efficiency and avoiding the build up of scale on said smooth external surfaces of said cooling coils due to the flow of the cooling water thereover, said helical coils being formed of lightweight aluminum metal having a high temperature expansion coefficient.

2. The invention defined in claim 1 wherein said turbulators are constituted by a helical strip carried on the internal surfaces of said cooling coil.

3. The invention defined in claim 1 wherein said turbulator is constituted by a plurality of sequentially connected beads for causing eddy-currents induced by accellerated fluid flow.

4. The invention defined in claim 1 wherein said cooling tower includes a fan, and the further improvement comprising a turbine for driving said fan, said turbine utilizing as a motive fluid water for cooling and washing said coils of scale.

5. The invention defined in claim 4 including means for controlling the pressure and amount of water driving said turbine to control said vibration of said coils.

6. The invention defined in claim 1 wherein said turbulator is constituted by an inner core for reducing the flow section of water and increasing the velocity thereof.

7. The invention defined in claim 6 wherein said turbulator includes a helical fin carried on said core.

8. The invention defined in claim 6 wherein said core has a plurality of torsion fins carried on the external surface thereof.

9. The invention defined in claim 6 wherein said core is star shaped in cross-section.

10. In a light weight cooling tower having a heat exchange assembly having at least helical hollow coils having smooth external surfaces carrying a heated fluid medium and over the external surface of which a cooling water flows, said helical coil having a smooth external surface and being mounted to permit maximum multidirectional thermal expansion and contraction of the coils' surface to crack scale and other film deposited on the surface by evaporation of said cooling water, the improvement comprising turbulator means for increasing the internal surface area of said helical hollow coils, said helical hollow coils being made of light weight aluminum metal having a high temperature expansion coefficient.

11. In a cooling tower having a fan for causing air flow through a closed circuit heat exchange unit and a cooling fluid for contacting cooling surfaces of said heat exchange unit, the improvement comprising, said cooling surfaces being the smooth external outer surfaces of the cooling coils defined in claim 10, an impulse turbine coupled in driving relationship to said fan, means for supplying cooling fluid to drive said impulse turbine and means for dispersing the cooling fluid after driving said turbine in the air stream created by said fan.

12. The invention defined in claim 11 wherein said cooling fluid is water, said heat exchange unit is a closed circuit heat exchange unit receiving a heated working medium and passing same through said heat exchanger, and including means for distributing the water onto said heat exchange surfaces after the energy thereof has been used to drive said impulse turbine.

13. The invention defined in claim 11 wherein said cooling fluid is water, said impulse turbine has a plurality of buckets, each said bucket being adapted to convert momentum energy in said cooling fluid to rotary motion driving said fan and distribute said water to said heat exchanger.

14. The invention defined in claim 11 wherein said cooling fluid is water, and includes means for capturing said water after it has flowed through said heat exchange unit and recirculating same through said turbine.

15. The invention defined in claim 11 wherein said cooling fluid is water, said impulse turbine has buckets dispersing said water into droplets of relatively uniform size and into the flow of cooling air from said fan and then upon said heat exchange unit.

16. The invention defined in claim 11 wherein the air and cooling fluid are driven in opposite directions.

17. The invention defined in claim 11 wherein the air and cooling fluid are driven in the same direction to said coils.

18. In a cooling tower having a fan for causing air flow through a closed circuit heat exchange unit and a cooling fluid for contacting cooling surfaces of said heat exchange unit, the improvement comprising;

an impulse turbine coupled in driving relationship to said fan, means for supplying cooling fluid to drive said impulse turbine and rotatable distributor means coupled to said turbine for dispersing the cooling fluid after the energy thereof has been used to drive said turbine in the air stream created by said fan.

19. In a cooling tower having hollow, helically spiralled, heat exchange cooling coils, said coils having smooth external surfaces and mounted to permit multidirectional expansion and contraction of at least said smooth outer surfaces, and means for causing a flow of air and water over the smooth external surfaces of said coils, improvement in the means for causing air and water to flow over said smooth external surfaces of said hollow helical coils comprising, an air blower fan, an impulse turbine distributing water on said coils and driving said blower fan, and nozzle means for driving said impulse turbine from the kinetic energy extracted from the flow of said water and means for regulating the amount of water impinging on the blades of said tubine to develop sympathetic vibrations in said hollow helical coils and enhance the cleaning thereof by said multidirectional expansion and contraction of said smooth outer surfaces.

20. The invention defined in claim 19 including a shaft, bearing means mounting said shaft in said cooling tower, means mounting said air blower fan on one end of said shaft, means mounting said impulse turbine proximate the other end of said shaft, and a water distribution member below said turbine for uniformly distributing water from which kinetic energy has been absorbed by said impulse turbine and uniformly distributing said water in the air stream created by said fan and onto said helical coils.

21. The invention defined in claim 19 wherein said air is caused to flow in a direction opposite that of the water in said cooling tower.

22. In a cooling tower having an air blower and an impulse turbine for converting kinetic energy in incoming water to rotating energy for driving said air blower, the improvement including a distribution disc immediately below said impulse turbine for receiving spent water from the blades of said impulse turbine and uniformly dispersing same in droplet form in the flow of air created by said air blower.

23. The invention defined in claim 22 including valve means for bypassing cooling water from said impulse turbine to control the speed of rotation of said turbine and the flow of air by said air blower.

24. The invention defined in claim 22 including valve means coupled to the incoming water to said impulse turbine and bypassing some of the water to said distributor and controlling the speed of said turbine.

* * * * *